United States Patent [19]

Hirose et al.

[11] Patent Number: 4,987,279

[45] Date of Patent: Jan. 22, 1991

[54] DISPLAY BUTTON OF PUSH-BUTTON SWITCH

[75] Inventors: Kenichi Hirose; Tadao Ichikawa, both of Tokyo, Japan

[73] Assignee: Nihon Kaiheiki Industrial Company, Ltd., Japan

[21] Appl. No.: 410,751

[22] Filed: Sep. 22, 1989

[30] Foreign Application Priority Data

Oct. 18, 1988 [JP] Japan ..... 63-135078[U]

[51] Int. Cl.[5] ..... H01H 9/18

[52] U.S. Cl. ..... 200/314; 200/312

[58] Field of Search ..... 200/314, 315, 316, 313, 200/312

[56] References Cited

U.S. PATENT DOCUMENTS

| | | | |
|---|---|---|---|
| 3,482,542 | 12/1969 | Mace | 200/315 X |
| 3,735,077 | 5/1973 | Ohashi | 200/315 |
| 3,789,173 | 1/1974 | Bury | 200/525 |
| 4,013,857 | 3/1977 | Tanaka | 200/315 |

FOREIGN PATENT DOCUMENTS

| | | | |
|---|---|---|---|
| 276463 | 8/1988 | European Pat. Off. | 200/314 |
| 2521753 | 11/1976 | Fed. Rep. of Germany | 200/313 |
| 3133134 | 3/1983 | Fed. Rep. of Germany | 200/314 |

*Primary Examiner*—Renee S. Luebke

*Attorney, Agent, or Firm*—Lorusso & Loud

[57] ABSTRACT

A display button of a push-button switch according to the invention includes a central design display portion and angular display portions, which serve for illumination, arranged on the display surface of a push-button, with a display of a color contrasting with that of the background. Displays having a variety of colors and modes can be presented by selectively illuminating and displaying both display portions.

7 Claims, 3 Drawing Sheets

DISPLAY BUTTON OF PUSH-BUTTON SWITCH

BACkGROUND OF THE INVENTION

This invention relates to a push-button switch having a push-button equipped with a display device.

In a conventional push-button switch, characters or symbols are merely displayed on the surface of the push-button. A lamp is used to illuminate the entire surface of the button, or a small number of characters or symbols are displayed by an LED display section provided on portion of the push-button.

However, with the push-button of the foregoing kind, only one type of display can be presented on the display surface of the push-button, and even if the switch is combined with a lamp, at best, all that can be illuminated and displayed is the open or closed state of the switch.

FIG. 1 is a perspective view showing a portion of the conventional push-button switch. In FIG. 1, numeral 1 denotes a push-button for operating the push-button switch, and numeral 2 denotes the main body of the switch. With a push-button switch of this type, the push-button 1 itself is of a single color, so that its brightness cannot be distinguished even if an internal lamp (not shown) is used. For this reason, the push-button switch lacks distinguishability in that, when the switch is used in a bright location, one cannot tell whether the lamp is lit or not. In addition, since the push-button is of a single color, the push-button 1 must be selected upon taking into consideration the color of a mounting plate to which the switch body 2 is attached.

FIG. 2 is a plan view showing another push-button switch according to the prior art. In FIG. 2, numeral 3 denotes a push-button for operating the push-button switch, 4 the switch body, and 5 an LED display portion. In this case, the arrangement is such that the LED display portion 5 is made to flash. However, since the surface area of the LED display portion 5 is small in comparison with the entire push-button 3, it is difficult to see. In addition, the push-button switch lacks distinguishability at bright locations.

Furthermore, an additional drawback is that, in a multiple-button arrangement such as on a keyboard, push-buttons of the same background color are arrayed together, so that it is difficult to find the location of each push-button at a single glance.

SUMMARY OF THE INVENTION

An object of the present invention is to provide a display button of a push-button switch which eliminates the aforementioned drawbacks, makes it possible to present plural types of displays and enables each push-button region to be readily distinguished.

According to the present invention, the foregoing object is attained by providing a display button of a push-button switch in which a display surface is provided with a design display portion and an illumination portion. In order to enhance the distinguishability of each portion, the design display portion is disposed at the approximate center of the display surface, and the illumination portion is disposed at the periphery of the design display portion. Further, in order to enhance distinguishability even in natural light, the design display portion and the illumination portion can be separately displayed and illuminated.

Other features and advantages of the present invention will be apparent from the following description taken in conjunction with the accompanying drawings, in which like reference characters designate the same or similar parts throughout the figures thereof.

DESCRIPTION OF THE PREFERRED EMBODIMENT

Figure 1:
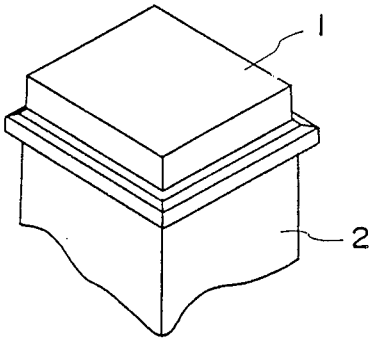
Fig. 1 (PRIOR ART)
FIG. 1 is a partial perspective view showing a push-button switch according to the prior art.
Figure 2:
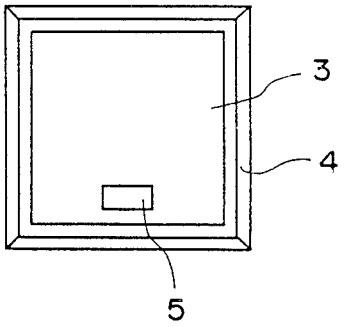
FIG. 2 is a plan view showing another push-button switch according to the prior art.
Figure 6:
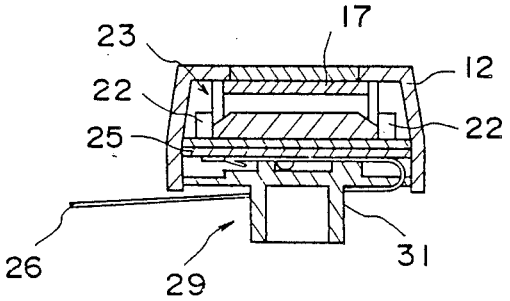
FIG. 6 is a sectional view showing the assembled push-button.
Figure 7:
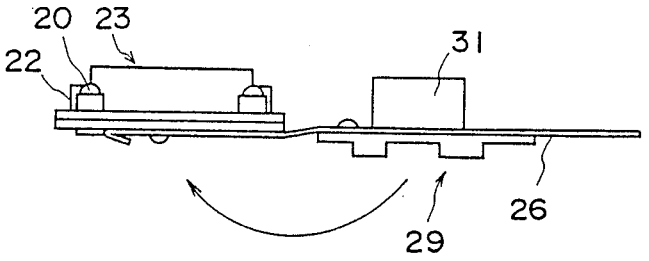
FIG. 7 is a side view illustrating the push-button in a partially assembled state.

An embodiment of the present invention will now be described in detail with reference to the drawings.

As shown in FIGS. 3 through 7, a push-button 11 includes a push-button cap 12, a holder 23, a printed circuit board 25, a flexible printed circuit board 26, and a plunger 29. These elements are employed as the components of a display device. The push-button cap 12 is light-transmissive and has a display surface 13. The display surface 13 has a design display portion 14 at its approximate central portion, and hook-shaped display portions 15 serving as illumination portions are provided at the perpheral corner portions of the display surface 13 surrounding the design display portion 14. Here the display surface 13 has the design portion 14, the hook-shaped display portions 15 and a background portion of the display surface 13, and these three can have different color tones, brightnesses and chroma.

Figure 4:
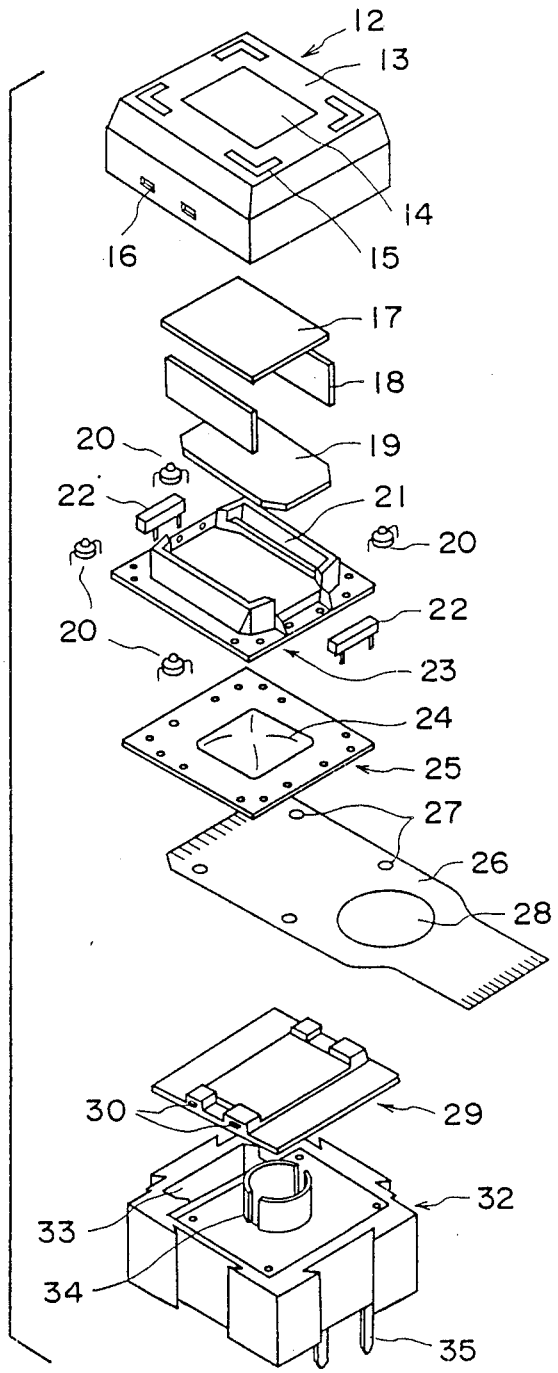
FIG. 4 is an exploded perspective view showing the push-button switch of the present invention.

The push-button cap 12 has a downwardly facing cavity on its inner side. Components from an LCD (liquid-crystal) display element 17 to a plunger 29 shown in FIG. 4 are accommodated within the cavity as means for providing an illuminated display. More specifically, the LCD display element 17 is provided facing the lower face of the push-button cap 12, one end of a connector 18 is connected to the LCD display element 17, and the other end of the connector 18 passes through a slit 21 in the holder 23 and is connected to the printed circuit board 25. A diffusing lens 19 is in contact with the LCD display element 17 and is provided in a prescribed space of the holder 23, disposed between the connectors 18. The holder 23 is provided with two opposing LED's (light-emitting diodes) 22 and with LED's 20 arranged at the four corners thereof. A printed circuit board 25 is provided in contact with the lower surface of the holder 23 and connected to the LED's 20, 22. An IC chip 24 having predetermined functions is provided at approximately the center of the printed circuit board 25 connected to the wiring portion of this circuit board.

A flexible printed circuit board 26 serves as the lead wires for the printed circuit board 25 and is bent at its central portion and installed so as to embrace the plunger 29. In other words, the flexible printed circuit board 26 has holes 27 for attaching it to the printed circuit board 25, and a hole 28 into which a downwardly projecting shaft 31 of the plunger 29 is loosely fitted. The plunger 29 has the aforementioned downwardly projecting shaft 31 (see FIGS. 6 and 7) and protrusions 30 (see FIG. 4) on opposing sides. The protrusions 30 are resiliently fitted into through-holes 16 of the push-button cap 12, whereby the elements from the LCD display element 17 to the flexible printed circuit board 26 are secured within the push-button cap 12. The reason for separately providing the printed circuit board 25 in addition to the flexible printed circuit board 26 is that it is necessary to fixedly support the flexible printed circuit board 26 on the printed circuit board 25, which is a rigid body that will not allow positional shifting of the lead wires of each light-emitting element.

The switch body 32 is formed to include a recess 33 in one side in order to accommodate a connector (not shown) and is equipped with an operating shaft 34 and terminal 35 joined to a contact mechanism within the switch body 32. The downwardly projecting shaft 31 of the plunger 29 of push-button 11 is coupled to the operating shaft 34. The connector (not shown) provided in the recess 33 is connected to a lead-out terminal portion of the flexible printed circuit board 26 of push-button 11 and is capable of being connected to an external circuit or the circuit of a switch.

Figure 3:
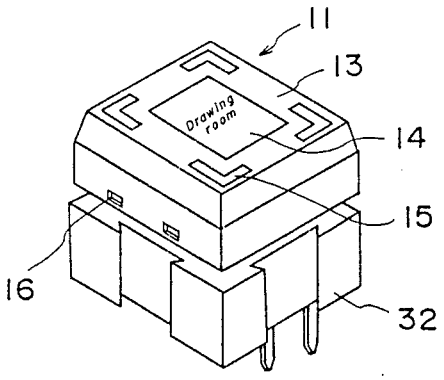
FIG. 3 is a perspective view showing a push-button switch according to the present invention.
Figure 5:
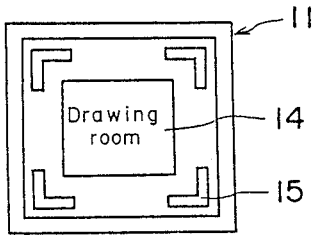
FIG. 5 is a plan view showing the push-button switch of the present invention.
Figure 8:
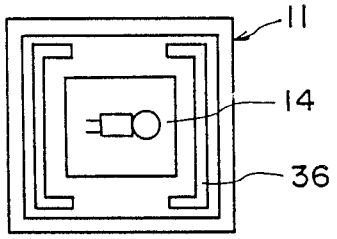
FIG. 8 is a plan view of a push-button illustrating a first modification of the present invention.

The hook-shaped display portions 15 in the above-described embodiment have a substantially L-shaped configuration, as shown in FIGS. 3 through 5. However, these can be formed as substantially C-shaped display portions 36, as illustrated in FIG. 8. In addition, the hook-shaped display portions 15, 36 and the design display portion 14 are illuminated by a common light source. However, if these are illuminated by light sources that differ from one another, various displays can be presented by combining these light sources with the functions of the IC chip 24. For example, the design display portion 14 can present a load use display, a display indicating whether a contact is in an open or closed state, a display of a plurality of functions or an input screen display from an external unit other than a discrete switch, and the hook-shaped display portions 15, 36 can present a display for clarifying the design display portion 14, a display for selecting a plurality of loads, a functional display such as an abnormality alarm employing flashing, a region display of the display surface 13, etc.

In addition, the design display portion 14 and the hook-shaped display portions 15, 36 can present displays visible in natural light.

Furthermore, by forming the display portions 14, 15, 36 of transparent electrodes and combining them with the IC chip 24, modes can be selected even by a touch sensor, and a display conforming to a mode can be presented by the design display portion 14. It should be noted that the hook-shaped display portions 15, 36 need not necessarily be provided at the four corners, for the arrangement thereof can be changed at will.

Figure 9:
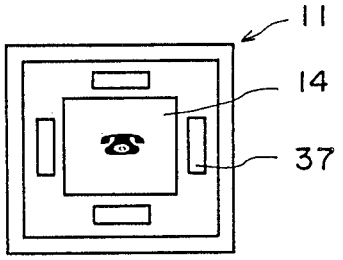
FIG. 9 is a plan view of a push-button illustrating a second modification of the present invention.

As shown in FIG. 9, it is permissible to dispose simple rectangular display portions 37 at the periphery of the centrally located design display portion 14.

Figure 10:
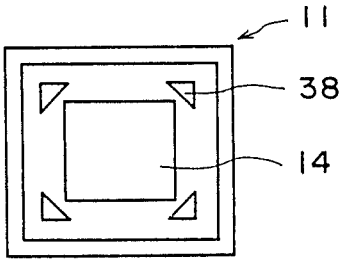
FIG. 10 is a plan view of a push-button illustrating a third modification of the present invention.

Also, as shown in FIG. 10, simple triangular display portions 38 may be arranged at the four corners of the design display portion 14.

Further, as examples of the display presented by the design display portion 14, FIG. 5 shows a display using English characters representing "Drawing Room", FIG. 8 a display using a symbol representing a bell, and FIG. 9 a display using a figure representing a telephone.

It should be noted that the present invention is not limited to the foregoing embodiment but can be modified in various ways based on the gist of the invention without departing from the scope of the claims thereof.

By virtue of the foregoing construction, the present invention has the following advantages:

(1) By using different colors for the design display portion, illuminated portion and background of the display surface, a readily distinguishable display can be presented when viewed in its entirety.

(2) The illuminated portion is disposed at the periphery of the design display portion and presents the hooked shapes which are non-continuous, i.e., which are partitioned from one another. As a result, distinguishability is enhanced.

(3) Since the design display portion and the hook-shaped display portions are displayed by illumination, it is possible to present a large variety of displays in comparison with a display using natural light.

(4) If a light source is provided for each display portion, a greater number of displays becomes possible. For example, related buttons in a multiple-button display can be displayed by the hook-shaped display portions, and an operating sequence of a plurality of push-buttons can be displayed by the hook-shaped display portions.

(5) Various types of displays become possible using a program incorporated in an IC. For example, it becomes possible to present a display by means of an input image signal which is entered from an external circuit via a connector, a display showing the state of a load connected to a terminal or an emergency state upon detecting the changeover state of a contact, a display for changing over a display in accordance with a predetermined program incorporated in an IC, etc.

(6) The component parts for presenting the display can be accommodated within the prescribed space of a small push-button.

(7) Identifying a large number of push-button displays is made very easy based on the display (characters, symbols, figures) of the design display portion, the display of the illuminated portion provided at each of the four corners, and the different colors of the illuminated portions. This makes it possible to prevent accidents based on misrecognition before they occur.

What is claimed is:

1. A push-button for a switch, said push-button comprising:

means for mounting said push-button, including a plunger, for reciprocating linear motion relative to the switch, along the axis of said plunger;

a display surface on the push-button, said display surface lying in a plane perpendicular to said axis;

a four-sided design display portion provided at approximately the center of said display surface and spaced from the edges of said display surface to define a peripheral portion on said display surface;

a plurality of separate illumination areas located in said peripheral portion of said display surface, said illumination areas including portions located on all four sides of said design display portion, thereby framing said design display portion; and first illumination means, within the push-button, for illuminating said illumination areas.

2. The push-button according to claim 1, wherein said design display portion is transparent and is illuminated by a light source within the push-button.

3. The push-button according to claim 1, wherein said plurality of illumination areas are displayed in respectively different colors.

4. The push-button according to claim 3, wherein said design display portion is transparent and is illuminated by a light source within the push-button.

5. The push-button according to claim 1, wherein said illumination areas have right-angled configurations and are located at the four corners of said display surface.

6. The push-button according to claim 5, wherein said plurality of illumination areas are displayed in respectively different colors.

7. The push-button according to claim 5, wherein said design display portion is transparent and is illuminated by a light source within the push-button.

* * * * *